US005103914A

United States Patent [19]

LaHaye

[11] Patent Number: 5,103,914

[45] Date of Patent: Apr. 14, 1992

[54] WELL TREATMENT SYSTEM

[76] Inventor: Philip LaHaye, 732 Summerland Dr., Winter Springs, Fla. 32708

[21] Appl. No.: 620,522

[22] Filed: Nov. 15, 1990

[51] Int. Cl.[5] ..... E21B 43/00

[52] U.S. Cl. ..... 166/310; 166/312; 166/902; 210/198.1

[58] Field of Search ..... 166/267, 304, 310, 312, 166/369, 53, 68, 75.1, 90, 902; 137/268; 422/263, 281, 282; 210/756, 754, 205, 206, 167, 169, 170, 198.1

[56] References Cited

U.S. PATENT DOCUMENTS

| | | | |
|---|---|---|---|
| 2,843,206 | 7/1958 | McNamara | 166/267 |
| 3,710,867 | 1/1971 | Bansbach | 166/902 |
| 3,899,027 | 8/1975 | Jenkins | 166/312 |
| 4,132,268 | 1/1979 | Harrison | 166/902 |
| 4,354,553 | 10/1982 | Hensley | 166/267 |
| 4,375,833 | 3/1983 | Meadows | 166/53 |
| 4,436,148 | 3/1984 | Maxwell | 166/312 |
| 4,584,106 | 4/1986 | Held | 210/169 |
| 4,732,689 | 3/1988 | Harvey et al. | 210/754 |
| 4,818,412 | 4/1989 | Conlan | 210/198.1 |
| 4,830,111 | 5/1989 | Jenkins et al. | 166/312 |
| 4,830,112 | 5/1989 | Erickson | 166/312 |
| 4,896,726 | 1/1990 | Ayres | 166/312 |

*Primary Examiner*—Terry Lee Melius
*Attorney, Agent, or Firm*—Macdonald J. Wiggins

[57] ABSTRACT

A system for chemically treating water in a water well utilizes a small pipe for diverting a small percentage of water being pumped from the well. The diverted water flows through a chamber containing concentrated treatment chemicals for producing a solution of the water treatment chemicals and the solution is injected into the well casing. The volume between the casing and the standpipe serves as a retention chamber for treating water before being drawn from the well.

15 Claims, 1 Drawing Sheet

WELL TREATMENT SYSTEM

BACKGROUND OF THE INVENTION

1. Field of the Invention

The present invention relates to water wells, and more particularly to a system for automatically chemically treating well water in the well.

2. Brief Description of the Prior Art

It is desirable in water wells to treat the water with oxidizing or chelating chemicals for purification purposes. In some installations, a retention chamber is placed in the water line from the pump with dry chemicals being fed into the chamber. It is also known to provide an opening into the well casing 13 into which chemical pellets are introduced to be dissolved. In such instances, water in the well casing when the pump is not operating will achieve a specific static level dependent upon the pressure from the aquifer which equalizes with the atmospheric pressure. The pellets will slowly dissolve in the water at this level. In instances where the pump is well below the static water level or, for an external pump the standpipe is well below the static water level, it is difficult to obtain a uniform concentration of the chemical with the result that either too much or too little may be present at any given time. Part of the problem is that the water is drawn at a deeper point in the well than the static water level and there is little if any tendency for the dissolved chemical to sink to the point at which water is being withdrawn.

Thus, there is a need for a system which will automatically treat the water in the well to the preferred concentration of the oxidizing or chelating agent and which will maintain such concentration over long periods of time.

While systems are known for adding chlorine and the like to swimming pools and the like, none of these appear suitable for wells. In U.S. Pat. No. 4,188,295 to Burnett, a chamber is provided into which a stick of chlorine is placed and depends upon water continuously circulating through the swimming pool and passing through the chamber to erode chlorine from the stick. A venturi to introduce chlorine into waste water is shown in U.S. Pat. No. 4,333,833 to Longley et al. U.S. Pat. No. 4,584,106 to Held teaches a mixing chamber having chlorine tablets wherein water is passed through the mixing chamber with means provided for controlling the size of the particles of chlorine tablets that will flow out of the chamber into the system. Jenkins, U.S. Pat. No. 3,899,027, teaches apparatus for cleaning the casing and other elements of a well by shutting off the output and recirculating all of the pumped water into the casing with a non-potable cleaning solution dissolved therein. The well must be purged after cleaning.

SUMMARY OF THE INVENTION

The invention will be explained with reference to chlorinating a well having a submerged pump although it is equally applicable to external pump well systems and to treating with a chelating agent. In general, the system of the invention provides an external tank or mixing chamber for containing chlorine-type chemicals. The water supply line from the well includes a check valve which is closed when the pump is not operating and permits water flow during operation of the pump. A small pipe is connected on the well side of the check valve such that, when the pump is operating, a small percentage of the water capacity of the well is diverted and flows out the small pipe. The diverted water is directed through a container of chlorine pellets or similar dry chlorine material. The tablets dissolve in the water in the chamber and the mixture which is then fed through a metering valve into the well head where it falls to the static water surface.

A relatively large mixture of water and chlorine is thus introduced into the well and will increase the head in the casing during the pumping operation. When the pump ceases to operate, the atmospheric pressure in the well head will cause the water level to drop to the normal static level, advantageously carrying the mixture of water and chlorine down the well casing. For the example of a submerged pump, after the system has been in operation for a period of time, it will be understood that the water in the casing down to the pump will contain a concentration of chlorine. From that point on, operation of the pump will therefore draw water from the casing which is acting as a retention vessel which will have a desired relatively uniform concentration of chlorine. During the retention time between pump cycles, the chlorine will oxidize impurities and the like which may normally be in the water.

It is therefore a principal object of the invention to provide a chemical treatment system for a water well which will inject water having a predetermined concentration of treating chemicals therein into the well head only when the well pump is operating such that the water will be forced downward toward the normal water source.

It is another object of the invention to provide a treatment system for water wells in which a charge of treated water is introduced into the well head only when the well pump is in operation.

It is still another object of the invention to provide a chemical treatment system for water wells having an external chamber into which a dry chemical is introduced and which forms a mixing chamber for dissolving the dry chemical in the water which is to be introduced into the well head.

These and other objects and advantages of the invention will become apparent from the following detailed description when read in conjunction with the drawings.

DETAILED DESCRIPTION OF THE PREFERRED EMBODIMENT

Figure 1:
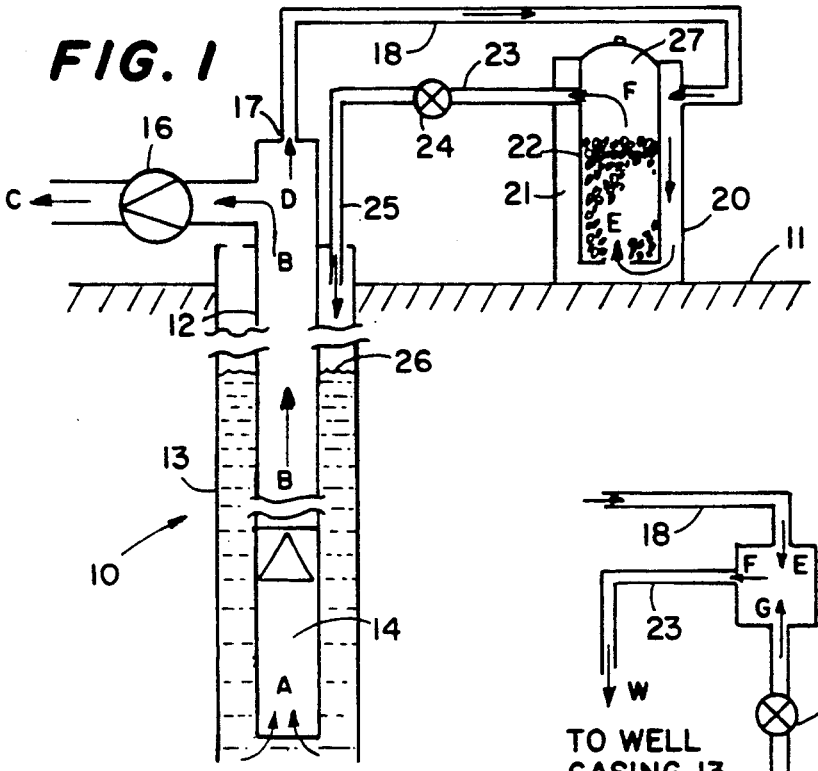
FIG. 1 is a schematic diagram of a well having a submerged pump and a system for automatically chlorinating the water therein.

Referring to FIG. 1, a cross-sectional schematic view of a water well 10 in earth 11 is shown. Well casing 13 has a submersible pump 14 disposed therein to the desired depth. Pump 14 is connected by a standpipe 12 to an above-the-ground point. Pump 14, when operating, draws water in from casing 13, as indicated by arrows A, which is pumped out of standpipe 12 as indicated by arrows B. A one-way check valve 16 is provided such that water flowing from pump 14 opens valve 16 to provide an output of water shown by arrow C. An opening 17 at the upper end of standpipe 12 causes a small percentage of the total water flow A to flow out opening 17 via pipe 18 to double walled chamber 20. As will be explained below, this percentage of flow may be on the order of 2–10% of the total pump output.

Chamber 20 is charged with dry chemical 22 which may be an oxidizing agent or chelating agent. Chemical 22 may be in the form of pellets or the like. The water flowing in pipe 18 is introduced into inner chamber 27 from reservoir portion 21 as indicated by arrow E. With the system in operation, it may be seen that the reservoir portion 21 of chamber 20 will normally be water filled. The dry chemical 22 will therefore dissolve in the water in inner chamber 27 producing a charge of water containing a concentration of the chemical. When the pump is operating, the water-chemical solution is forced out of inner chamber 27 as indicated by arrow F into pipe 23 and via metering valve 24 and pipe 25 into well casing 13. As the water and chlorine solution flows into well casing 13, it will temporarily raise the static level of water 26. When pump 14 ceases to operate, the weight of the water-chlorine mixture and the normal atmospheric pressure will cause the static water level 26 to return to its normal level thereby pushing untreated water downward. As will now be recognized, this action advantageously permits the well casing 13 and standpipe 12 to serve as a retention vessel. Metering valve 24 is adjusted to cause the flow of water from outlet 17 to be in the range of 2–10% of the pump output.

Assuming that the system has just been put in operation, this action will be repeated on each cycling of pump 14 and, at some point in time, the water and chemical solution will reach the inlet portion of pump 14 and will be drawn into the pump as indicated by arrows A. The concentration of chemical 22 in the water flowing from pipe 25 will depend upon adjustment of metering valve 24 and the periods of operation of pump 14. Advantageously, chemically treated water will be added via pipe 25 only when pump 14 is running. During the period of retention in well casing 13, oxidation or chelation will be proceeding. By testing the residual chemical in water flow C, the correct setting of metering valve 24 may be determined.

Although FIG. 1 shows a submerged pump, it will be clear that the system of the invention is equally applicable to a well using an external pump and a standpipe disposed in well 10 to a desired depth.

Figure 2:
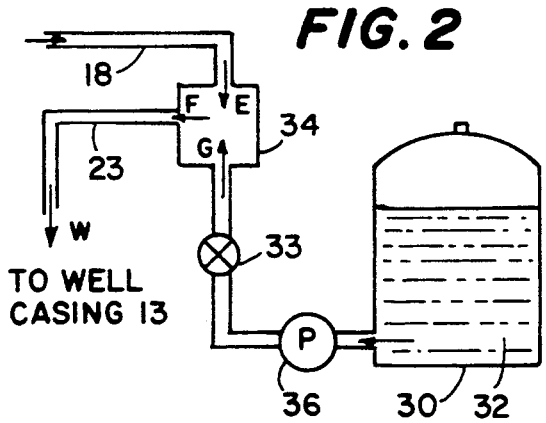
FIG. 2 is an alternative arrangement for the system of FIG. 1 in which a liquid concentrate chemical and a mixing and injecting pump is utilized.

Turning now to FIG. 2, an alternative version of the system of FIG. 1 is shown in which a tank 30 is filled with a concentrated chemical 32 in liquid form. A small electrically operated pump 36 is connected to operate when pump 14 of FIG. 1 is operating. This will feed the chemical concentrate 32 via metering valve 33 to mixing chamber 34. Well water E enters chamber 34 via pipe 18 as previously described and mixes with concentrate 32 entering chamber 34 as shown by arrow G. The diluted mixture is fed as indicated by arrow H to pipe 23 and via metering valve 24 into well casing 13.

Figure 3:
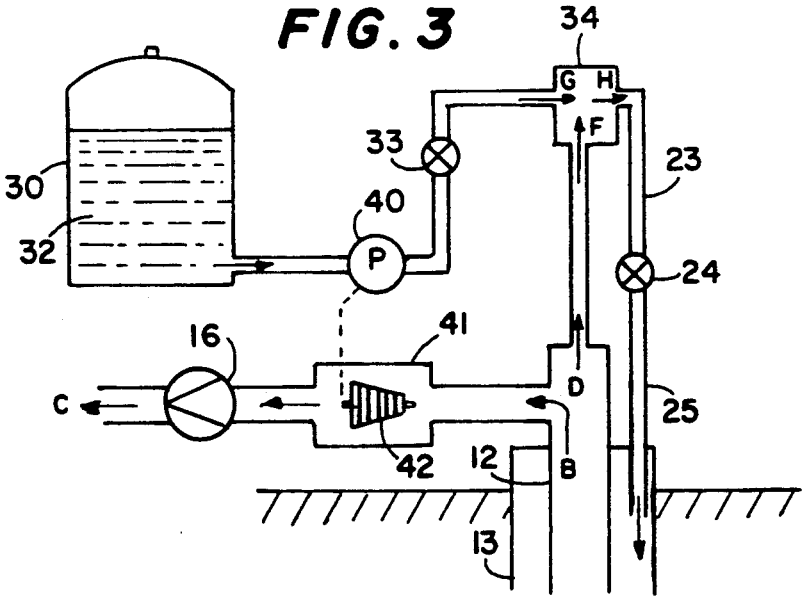
FIG. 3 is a schematic diagram of an alternative arrangement of FIG. 2 in which a mixing and injecting pump is operated from an in-line turbine.

It is also possible to provide a system as described with respect to FIG. 2 without requiring a separate electrically operated pump 36. As shown in the schematic diagram of FIG. 3, a pump 40 is operated by an in-line turbine system 41. When pump 14 is in operation, the water flow shown by arrow B turns turbine rotor 42 thereby operating pump 40. Concentrate 32 is pumped into mixing chamber 34 (arrow G) and there mixes with the water flowing from well 10 as indicated by arrows D and F. The water-concentrate solution is then injected into casing 13 via metering valve 24 as indicated by arrow H.

A typical oxidizing agent for use with the implementation of FIG. 1 is calcium hypochlorite, and of FIG. 2 is sodium hypochlorite. As will now be recognized, a simple automatic system for chemically treating well water at the well head has been described which overcomes the disadvantages of the present methods and which maintains a uniform concentration of the chemical and a retention feature to ensure that the delivered water is sanitary.

The system as disclosed hereinabove provides the means for practicing a method of chemically treating well water with oxidizing and chelating chemicals, the method including the steps of:

a) diverting water being pumped from a water well standpipe in a percentage in the range of 2–10% of the total water flow;

b) injecting the diverted water into a reservoir;

c) providing a chamber having a concentrated water treating chemical;

d) dissolving a portion of the concentrated chemical in water from the reservoir to form a solution thereof;

e) injecting the solution into the well casing; and f) thereafter using the well casing as a retention vessel for the solution to oxidize and chelate the water therein.

Although specific examples have been used in explaining the invention, it is to be understood that various modifications may be made thereto without departing from the spirit and scope of the invention.

I claim:

1. In a water well having a casing, a standpipe, a well pump for drawing water from said standpipe, a well outlet from the standpipe, and a check valve in the well outlet for permitting one-way water flow from the outlet, wherein the improvement of a system for automatically continuously injecting a chemical water treating agent into the well during operation of the well pump comprises:

means for diverting water from said standpipe of an amount in the range of 2 to 10 percent of the amount flowing from said outlet during operation of the well pump;

means for mixing a concentrated chemical treating agent with water diverted from said standpipe during operation of the well pump to produce a solution of a desired concentration of water and said chemical treating agent; and means for continuously introducing said solution into the well casing above a lower end of the standpipe to raise a static level of water in the casing when the well pump is operating, said introducing means utilizing the casing as a retaining vessel for said solution.

2. The improvement as recited in claim 1 in which said diverting means includes a conduit connected to said outlet and said introducing means an adjustable metering valve.

3. The improvement as defined in claim 1 in which said mixing means includes a double walled chamber having an inner chamber for containing said chemical treatment agent in a dry form, and an outer chamber communicating with said inner chamber, said outer chamber for receiving and holding water diverted from said standpipe.

4. The improvement as recited in claim 3 in which said introducing means includes an adjustable metering valve having an input thereof connected to said inner chamber and an output thereof connected to said well casing.

5. The system as recited in claim 1 in which said mixing means includes:

a reservoir containing said chemical treating agent in a liquid form;

a mixing chamber; and a circulating pump connected to pump a preselected amount of said liquid concentrated chemical treating agent from said reservoir to said mixing chamber when said well pump is operating, said mixing chamber having an outlet connected to said diverting means and an inlet connected to said introducing means whereby diverted water mixes with said liquid concentrated chemical treating agent in said mixing chamber and such mixture is introduced into said well casing.

6. The system as recited in claim 5 in which said circulating pump is an electrical type connected to be energized only when said well pump is operating.

7. The improvement as defined in claim 1 in which said chemical treating agent is an oxidizing agent.

8. The system as recited in claim 7 in which said oxidizing agent is dry calcium hypochlorite.

9. The system as recited in claim 7 in which said oxidizing agent is a concentrated liquid form of calcium hypochlorite.

10. In a water well having a casing, a standpipe, a pump for pumping water from said standpipe, an outlet from said standpipe, and a check valve in said outlet for permitting one-way flow from said outlet, the improvement of a system for injecting a chemical water treating agent into said well comprising:

a) a mixing chamber having i) a water reservoir portion connected to said standpipe for receiving water therefrom, ii) a chemical storage portion in communication with said reservoir portion;

b) a metering valve disposed in a conduit connected between said chemical storage portion and said well casing, said metering valve adjusted to divert an amount of water to said water reservoir portion in the range of 2 to 10% of water flowing from said standpipe when said pump is in operation; and c) a dry, water-treating chemical disposed in said chemical storage portion, said chemical and said water from said reservoir portion forming a water treatment solution, said solution thereafter being injected into said casing during operation of said pump to raise the static level of water therein during nonoperation of said pump, said casing thereby being used as a retaining vessel for said water treatment solution.

11. The improvement as recited in claim 10 in which said pump is a submerged type.

12. In a water well having a casing, a standpipe, a submerged well pump for pumping water from said standpipe, a well outlet from said standpipe, and a check valve in said outlet for permitting one-way water flow from said outlet, the improvement of a system for injecting a chemical water treating agent into said well comprising:

means for diverging a small amount of water from said standpipe flowing from said outlet during operation of said well pump;

a reservoir containing a concentrated form of said chemical treating agent in a liquid form;

a mixing chamber having a first input connected to said diverting means;

a circulating pump connected said chamber to pump a preselected amount of said chemical treating agent from said reservoir to said mixing chamber, said mixing chamber having an outlet connected to said casing and a second inlet connected to said circulating pump; and a water turbine disposed in said well outlet, said water turbine operatively coupled to said circulating pump and operated by flow of water from said standpipe when said well pump is operating.

13. A method for automatically chemically treating water in a well, the water well having a well casing, a standpipe extending below a static water level of the well, a submerged pump in the well casing, first and second outlets from the standpipe, and a check valve in the first outlet for permitting water flow therefrom, comprising the steps of:

a) diverting water being pumped from the standpipe and out the first outlet in a small percentage of the total flow of the water being pumped, the diverted water thereby issuing from the second outlet;

b) injecting the diverted water into a chamber containing a concentrated water-treating chemical;

c) dissolving a portion of the concentrated chemical in the injected water to form a treating solution;

d) injecting the solution from the chamber into the well casing during operation of the well pump; and e) using the portion of the well casing above the pump as a retaining vessel for the solution during nonoperation of the pump to thereby treat the water in the casing.

14. The method as defined in claim 13 which further includes the step of:

f) mixing the treated solution in the retaining vessel portion of the well casing with well water during operation of the submerged pump.

15. The method as defined in claim 13 which step a) diverts water in the range of 2 to 10% of the total flow of water being pumped.

* * * * *